US009915111B2

(12) United States Patent
Rousseau et al.

(10) Patent No.: US 9,915,111 B2
(45) Date of Patent: Mar. 13, 2018

(54) SYSTEM AND METHOD FOR CONDUCTING DRILLING AND CORING OPERATIONS

(75) Inventors: Denis Rousseau, Pueblo West, CO (US); Jeremy Myers, Calgary (CA); Richard Havinga, Okotoks (CA)

(73) Assignee: Xtreme Drilling and Coil Services Corp., Houston, TX (US)

( * ) Notice: Subject to any disclaimer, the term of this patent is extended or adjusted under 35 U.S.C. 154(b) by 746 days.

(21) Appl. No.: 13/577,003

(22) PCT Filed: Feb. 3, 2011

(86) PCT No.: PCT/US2011/023605

§ 371 (c)(1),
(2), (4) Date: Nov. 16, 2012

(87) PCT Pub. No.: WO2011/097380

PCT Pub. Date: Aug. 11, 2011

(65) Prior Publication Data

US 2013/0056276 A1 Mar. 7, 2013

Related U.S. Application Data

(60) Provisional application No. 61/301,116, filed on Feb. 3, 2010.

(51) Int. Cl.

| | |
|---|---|
| ***E21B 19/22*** | (2006.01) |
| ***E21B 7/02*** | (2006.01) |
| ***E21B 25/00*** | (2006.01) |
| *E21B 15/04* | (2006.01) |
| *E21B 1/00* | (2006.01) |

(52) U.S. Cl.

CPC ..... *E21B 19/22* (2013.01); *E21B 7/02* (2013.01); *E21B 25/00* (2013.01); *E21B 1/00* (2013.01); *E21B 15/04* (2013.01)

(58) Field of Classification Search

CPC . E21B 1/00; E21B 15/04; E21B 19/08; E21B 19/22; E21B 25/00; E21B 25/02; E21B 25/04; E21B 25/10; E21B 7/02

See application file for complete search history.

(56) References Cited

U.S. PATENT DOCUMENTS

| | | | | |
|---|---|---|---|---|
| 4,969,528 | A * | 11/1990 | Jurgens | E21B 25/04 175/101 |
| 7,152,672 | B1 * | 12/2006 | Gipson | 166/77.2 |
| 7,240,744 | B1 * | 7/2007 | Kemick | 175/106 |
| 2004/0140131 | A1 * | 7/2004 | Susman | 175/296 |
| 2004/0206551 | A1 * | 10/2004 | Carriere et al. | 175/203 |

(Continued)

*Primary Examiner* — Robert E Fuller
*Assistant Examiner* — Christopher J Sebesta
(74) *Attorney, Agent, or Firm* — Bushman Werner, P.C.

(57) ABSTRACT

A system and method are disclosed for drilling a well and obtaining a downhole core sample. A drilling rig includes a pivotal mast. The mast supports an injector thereon with an injector axis offset with respect to the central axis of the mast when the drilling rig is handling threaded tubular. The mast also supports a drive unit. A drilling assembly includes coil tubing, the injector, and a bottomhole assembly including a percussion tool suspended in the well from the coil tubing. A coring assembly includes a threaded tubular string and the drive unit supported on the mast for rotating the threaded string and the coring bottomhole assembly while the injector is spaced from the axis of the mast.

11 Claims, 7 Drawing Sheets

(56) References Cited

U.S. PATENT DOCUMENTS

| | | | | |
|---|---|---|---|---|
| 2005/0252687 | A1* | 11/2005 | Egerstrom | 175/61 |
| 2006/0231267 | A1* | 10/2006 | Wood | 166/379 |
| 2007/0125549 | A1* | 6/2007 | Wood | 166/380 |
| 2007/0209791 | A1* | 9/2007 | Havinga | 166/77.2 |
| 2008/0156537 | A1* | 7/2008 | Stockton | 175/58 |

* cited by examiner

SYSTEM AND METHOD FOR CONDUCTING DRILLING AND CORING OPERATIONS

CROSS-REFERENCE TO RELATED APPLICATION

This application claims the priority of U.S. Provisional Application No. 61/301,116 filed on Feb. 3, 2010.

FIELD OF THE INVENTION

The present invention relates to a coil tubing system including a rig and, more particularly, to using coil tubing and a drilling bottom-hole assembly (BHA) during mining exploration applications, and to using threaded tubulars and a coring bottomhole assembly during coring operations with the same rig.

BACKGROUND OF THE INVENTION

In typical mining operations, an earth borehole apparatus is used to drill a borehole and then obtain a core sample from a desired subsurface locations. Analysis of a core sample provides information as to the composition of the subsurface formation and helps geologists determine whether further mining activity is warranted. Apparatus for conducting coring operations, as well as core sampling tools, e.g., core barrels, are well known to those skilled in the art.

In the drilling of a conventional earth and/or hard rock borehole prior to coring, successive lengths of the casing are connected to a suitable bottom-hole assembly, such as a reverse circulation air hammer or a drill bit. In a typical coring operation, the apparatus comprises a mast, a powered drill head or drive unit with a chuck mounted on the mast for longitudinal movement therealong, and threaded tubular pipe similar to surface casing used in oil and gas well drilling, or a rod string.

Typically, a borehole used in the mining exploration coring operations will be up to about 3,000 meters deep, and can be vertical or at an angle up to about 45°. Drilling below a cased surface borehole may be conducted with various types of drilling methods, such as diamond bits or percussion reverse circulation air hammer bits. The cuttings are commonly returned to the surface using an aqueous medium. The fluid is pumped down the drill string and returned up the annulus between the borehole and the drill string. The cuttings and chip samples may be analyzed to determine the general composition of the subsurface formation at any given depth. In the past, coring activities have been conducted after drilling with a string of rods, or with casing pipes extending to the desired depth to determine the precise composition of the cored sample.

One of the drawbacks of these conventional methods of drilling is that it requires the making and breaking of successive length of threaded drill pipe, which is jointed. This operation is time consuming and labor intensive, as well as posing safety concerns. The use of so-called down the hole (DTH) percussive drilling assemblies, particularly so-called water hammers, has found wide-spread acceptance in the mining field for percussive drilling of a bore hole in hard rock condition.

Relevant patents include U.S. Pat. Nos. 4,694,911, 5,476,421, 5,647,445, 5,803,118, 6,125,952, 7,073,610, 7,240,744, 7,617,886, and 7,748,478. Other publications of interest include a description of products and services of Coil Tubing Technology Holding Inc., Products & Services, *Operational Strategy* by Scientific Prospectus: Integrated Ocean Drilling Program Expedition 313, *Steerable Percussion Air Drilling System* by Huy Bui, et al., *Percussion Drilling in Oil Industry: Review and Rock Failure Modelling* by Gang Han, et al., *Water Driven Down-the-Hole Well Drilling Equipment for Hard Rock* by Bo Nordell, et al., U.S. Publications 2004/0140131 and WO 2008/068546.

The disadvantages of the prior art are overcome by the present invention, an improved system for drilling and coring a mining exploration well is hereinafter disclosed.

SUMMARY OF THE INVENTION

It is therefore the logic of the present invention to provide a system for drilling earth and/or hard rock boreholes, then for coring during mining exploration activities.

Another object of the present invention is to provide a method for drilling an earth and/or hard rock type borehole, and then core sampling in mining exploration applications.

In one aspect, the present invention provides a drilling system comprising a rig with a mast, a coil tubing injector attached to the mast for selective movement into an out of alignment with the mast, and a drilling BHA comprising a percussive drilling component, e.g., water hammer, a shock sub assembly and a down-hole fluid motor. The same drilling rig may be used for coring conducted with threaded tubulars, with a drilling head chuck or drive unit carried by the mast for longitudinal movement along the mast while rotating the tubular string, and a coring BHA including a core sampler.

These and further features and advantages of the present invention will become apparent from the following detailed description, wherein reference is made to the figures in the accompanying drawings.

DETAILED DESCRIPTION OF PREFERRED EMBODIMENTS

Figure 1:
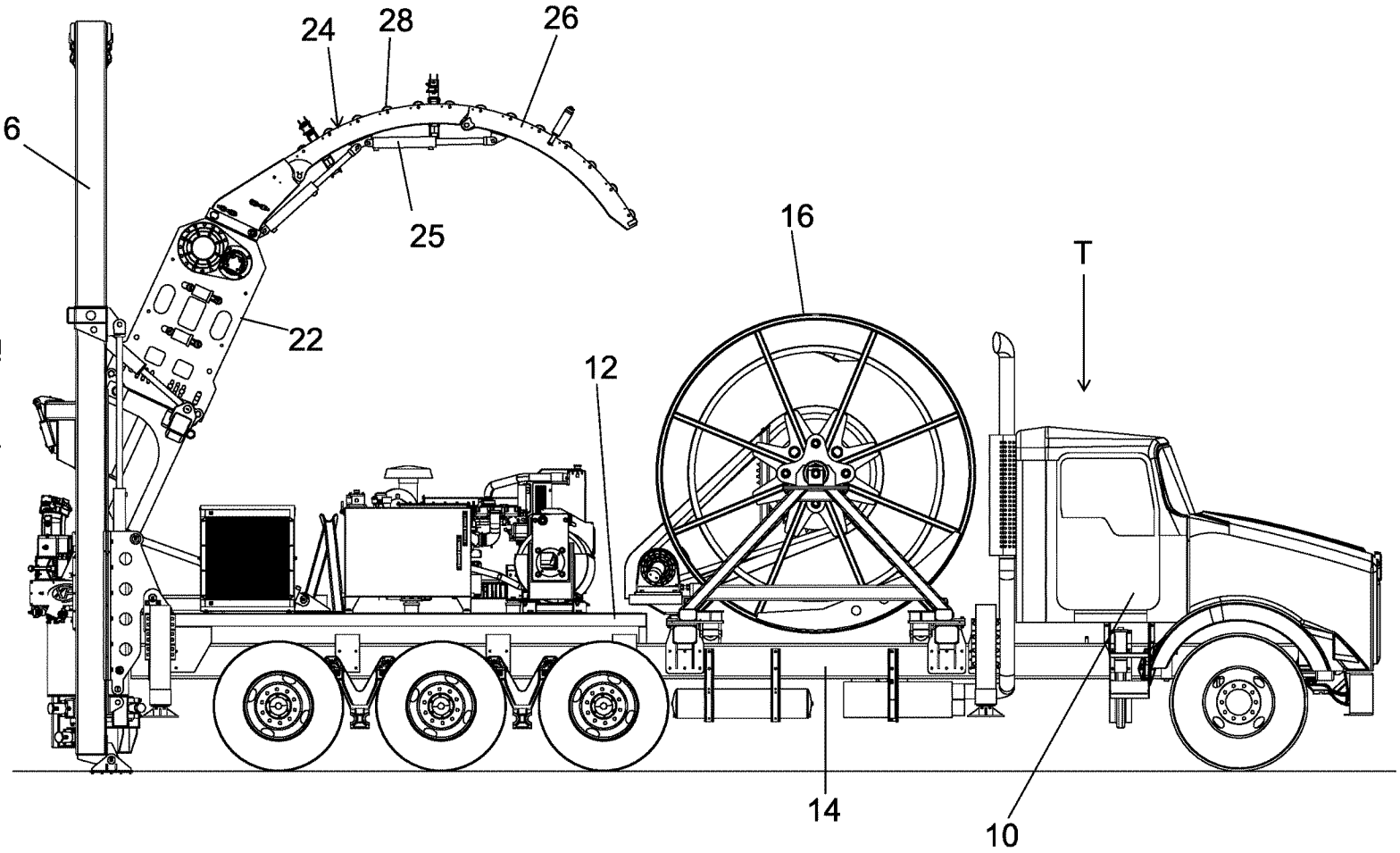
FIG. 1 is an elevational, side view of one drilling rig in accordance with the present invention.
Figure 2:
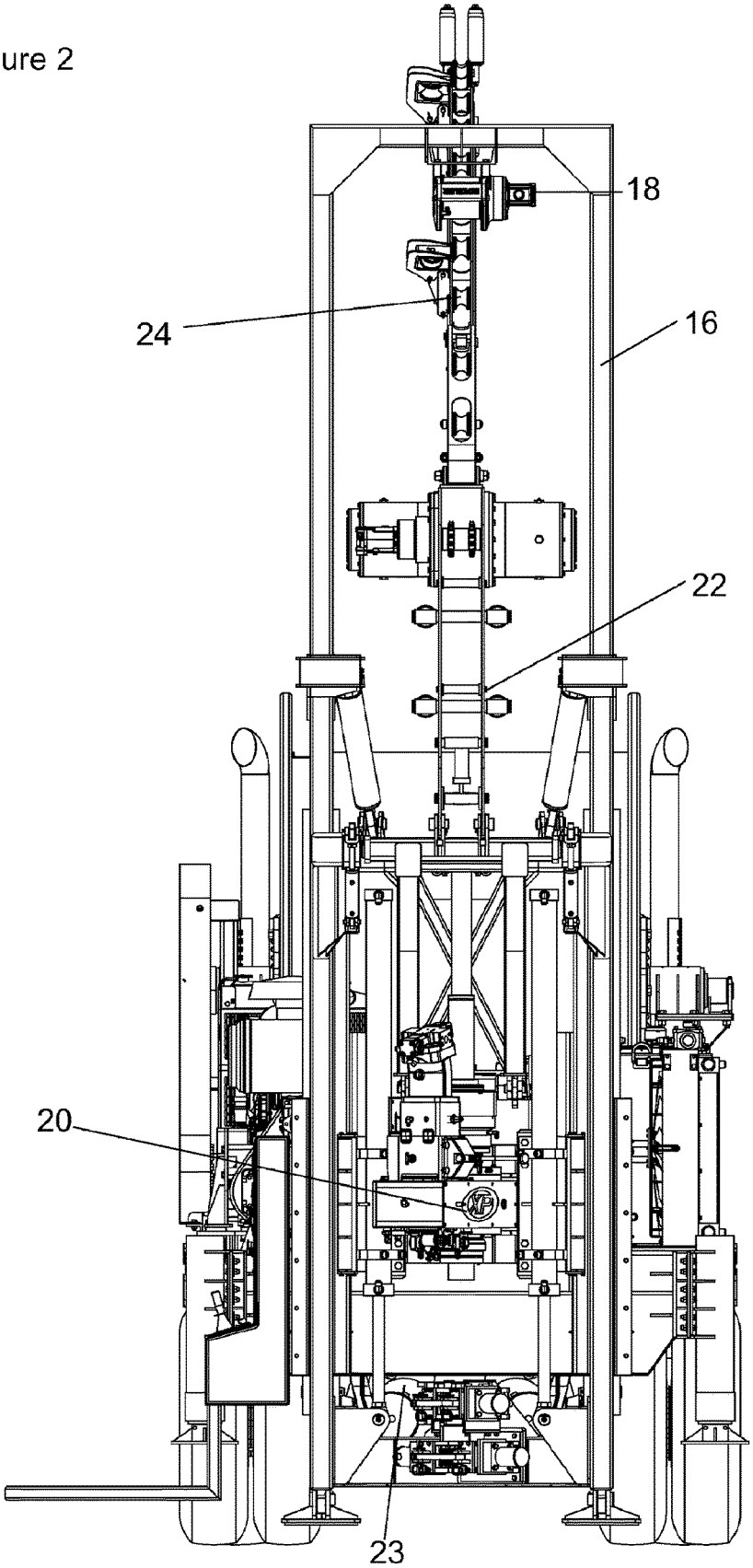
FIG. 2 is an end view of the assembly shown in FIG. 1.
Figure 4:
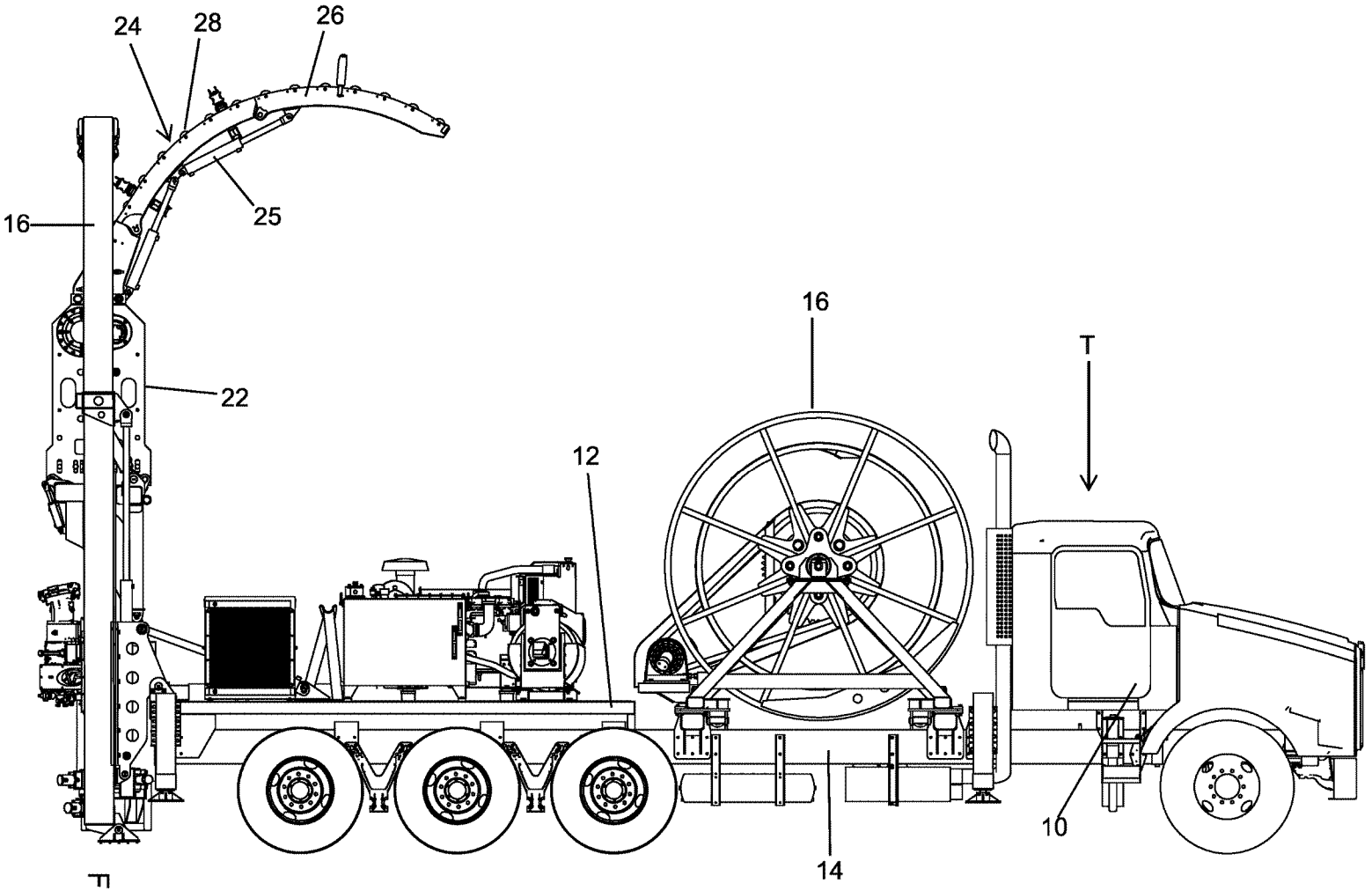
FIG. 4 is an elevational, side view of the drilling rig shown in FIG. 1 with the coil tubing injector aligned with the mast.

Referring first to FIG. 1, there is shown a carrier comprised of a truck T having a cab 10, a bed 12, and a frame 14 on which is mounted a reel 16 of coil tubing (not shown). Carried on bed 12 is usual equipment such as pumps, generators, hydraulics, etc. Pivotally attached to the bed of the truck T is a mast 16 having a core recovery winch 18 at the top thereof. A drilling head chuck or drive unit 20 as shown in FIG. 2 is connected to mast 16 for longitudinal movement therealong by hydraulic piston/cylinder assemblies. Although shown in a vertical position, it will also be appreciated that mast 16 can be angled at any selected angle up to about 45° to drill off-vertical holes as desired. The drilling head chuck or drive unit 20 is positioned below the injector 22 when the injector is aligned with the mast, and rotates and preferably moves along the mast as threaded tubulars are lowered into or pulled out of the well. Disposed below drill head/chuck 20 is a make-break wrench assembly 23, so that successive joints of the casing or drill pipe can be made up or broken out as drilling of a borehole proceeds or withdrawal of the casing or drill pipe occurs. A coil tubing injector 22 is pivotally attached to mast 16, and has a first position shown in FIG. 1, wherein it is out of line with the central axis of mast 16, but can be moved to a second position as shown in FIG. 4 wherein coil tubing injector 22 is in line with a central axis of the mast 16.

Extending from the top and attached to coil tubing injector 22 is a segmented guide arch shown generally as 24, having a first section 26 and a second section 28. The guide arch 24 may be moved from its substantially horizontal transportation position, wherein injector 22 and guide arch 24 rest on a suitable support or bed 24 for transit, to the vertical position, as shown in FIG. 1, by pivoting the mast 8 to the upright position.

Sections 26 and 28 of guide arch 24 are connected by a hydraulic/piston cylinder arrangement 25, so that when injector 22 is in its operative position, i.e., pivoted so as to be in line with mast 16, section 26 is pivoted by means of hydraulic piston cylinder 25, so that a smooth curve is formed whereupon coil tubing from reel 16 can be passed through guide arch 24 and into injector 22.

Figure 3:
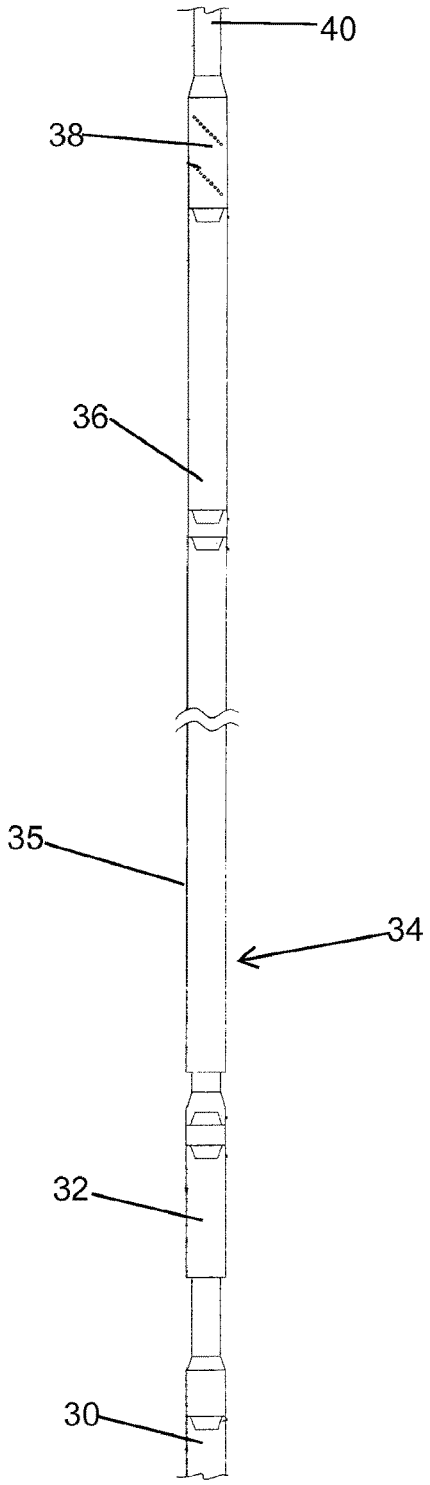
FIG. 3 is an elevational view of a BHA for use in the drilling.

The drilling BHA of the present invention is generally comprised of drill collars, one or more stabilizers, a shock absorber sub, a downhole fluid motor or mud motor, a water hammer and a connection to connect to the coil tubing. One such assembly is shown in FIG. 3 which shows a water hammer 30 connected to a shock sub 32, which in turn is connected to a mud fluid motor 34, which is comprised of a drive shaft section 35 and a specialized fluid motor section 36 for this specific application. Such mud motors, commonly known as Moineau motors, are widely used in the drilling of oil and gas well and other boreholes and are well known to those skilled in the art. A suitable connector 38 connects the drilling BHA to the end of the coil tubing 40. Although not shown, but as noted above, the BHA would also include drill collars and drill hole stabilizers to add weight and maintain a straight hole, and could also include various crossover subs as needed. In the present invention, the shock absorber sub 32 minimizes damage that could occur to the coil tubing 40 or upper components of the BHA from forces generated by the water hammer 30 when drilling the borehole. This is particularly important in the case of coil tubing because of its relatively lower strength compared to conventional drill pipe typically used in prior art drilling methods. In any event, once the drilling BHA is assembled and at least partially in the hole, the injector may be moved to the in line position, as shown in FIG. 4, and the drilling BHA connected to the coil tubing 40 which extends through the drilling head/chuck 20 and the coil tubing is powered by the injector during drilling operations.

Drilling is conveniently carried out using, for example, a DTH water hammer 30 manufactured and marketed by Wassara. Water hammers of the type under consideration are generally powered by high water pressure which in this case is pumped through coil tubing 40 using pumping equipment mounted on the bed 12 of truck T. The high pressure water or other incompressible fluid provides both the driving force for the hammer and rotation of the rotor of the fluid motor 34 for delivering a known revolution range needed for adequate drilling performance, as well as returning the cuttings to the surface for possible analysis.

Because it is necessary for the efficiency of drilling to rotate the water hammer 30 so as to present a constantly changing face for impact, down-hole fluid motor 34 is employed to rotate the portion of the BHA below motor 34. Mud motor 34 in conjunction with steering capabilities also ensures that the borehole stays on a desired track.

Because coil tubing is used, there is no necessity to stop the drilling operation for the purpose of adding additional joints of drill pipe as would be conventionally done. Furthermore, when it is necessary to replace the bit mounted on the water hammer, it is unnecessary to break out successive joints of threaded tubular rods since the coil 40 can simply be reeled back upon the reel 16 to retrieve the drilling BHA and replace the bit.

In a typical coring operation, the drilling head/chuck 20 and mast 16 in the FIG. 1 position may be used to obtain a core sample using successive lengths of casing or other threaded tubulars for lowering a core sampler to the desired bore depth, then the tubular string rotated to rotate the sampler and obtain the desired core. In this regard, crown block assembly/winch 18 can be used to move the casing joints in line with mast 16 so they can be connected conventionally, generally manually. The casing may serve as surface casing or a liner for further drilling activities.

Figure 5:
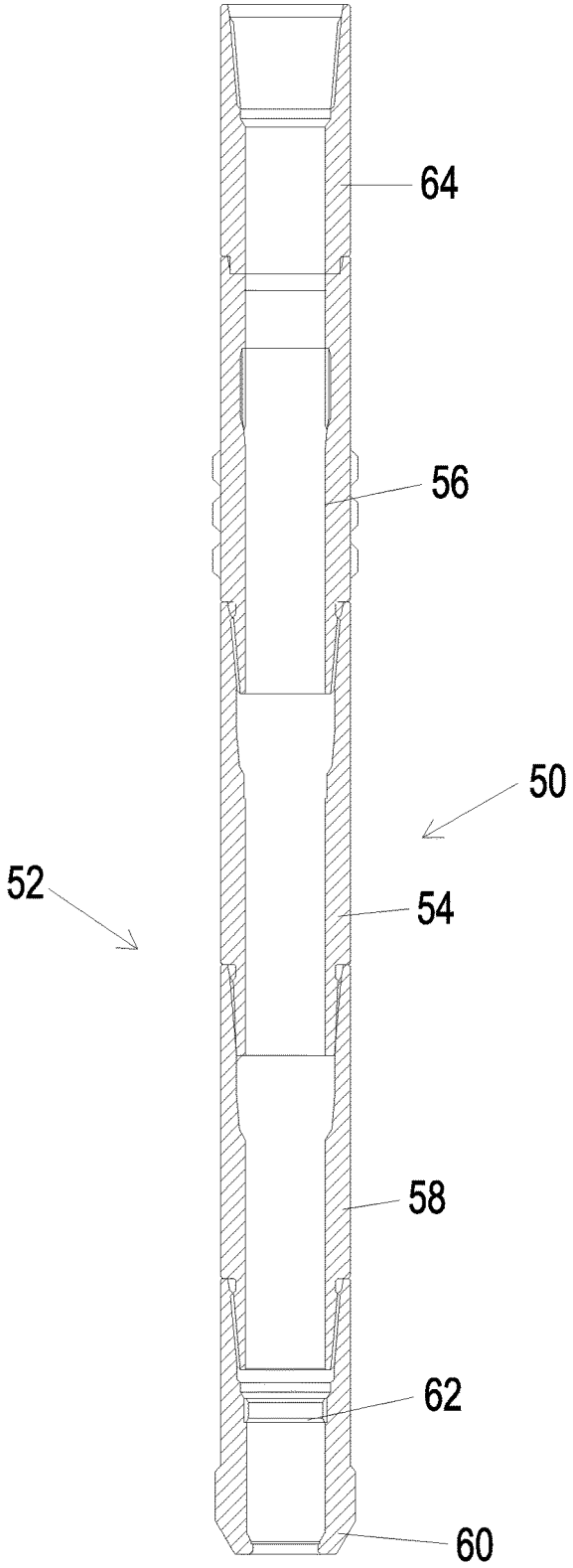
FIG. 5 is an elevational view of a BHA for use in coring.
Figure 6:
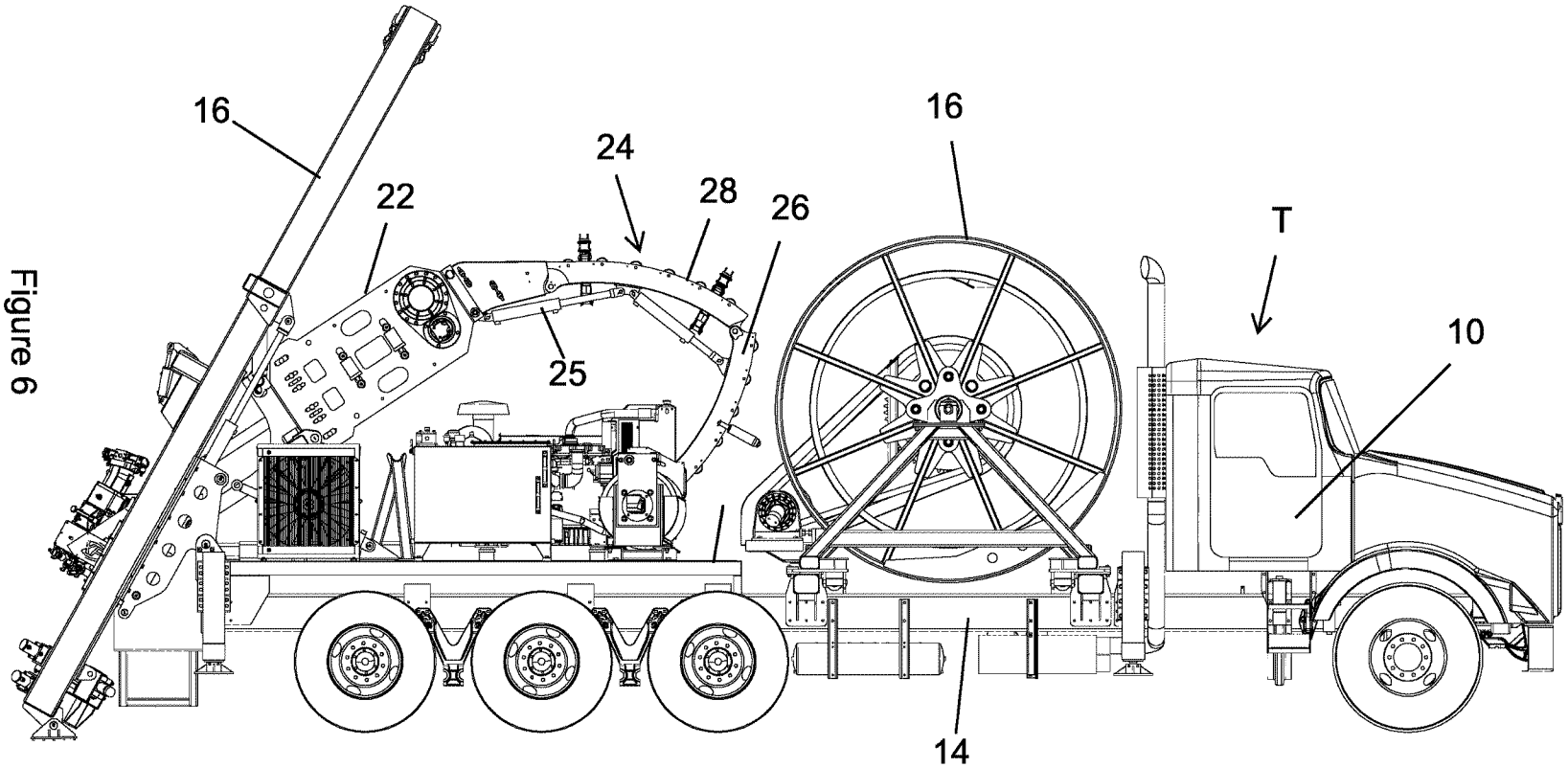
FIG. 6 is an elevational, side view of the drilling rig shown in FIG. 1 with the mast pivoted.
Figure 7:
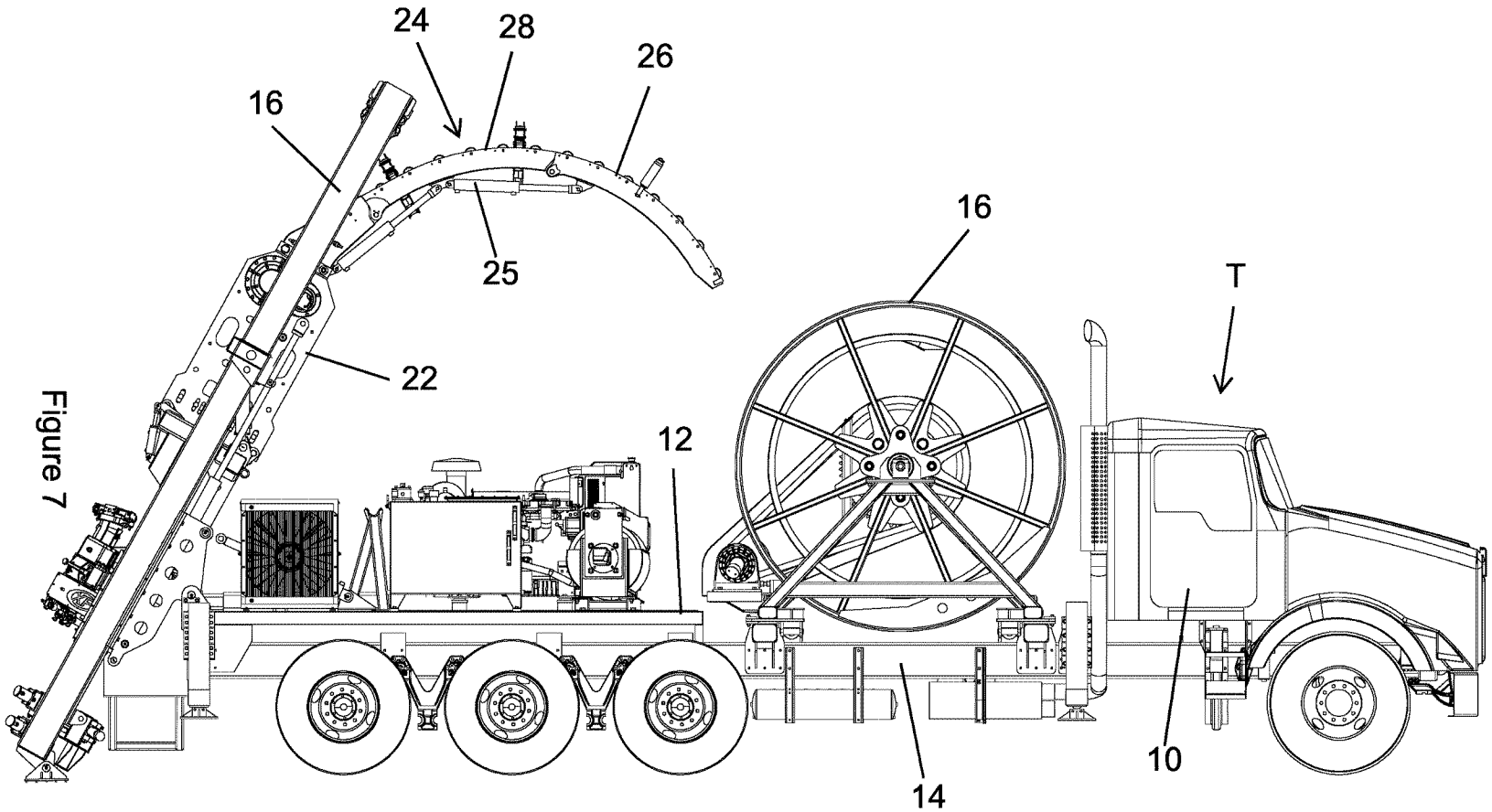
FIG. 7 is an elevational, side view of the drilling rig shown in FIG. 6 with the coil tubing injector aligned with the pivoted mast.

A suitable coring bottomhole assembly 50 as shown in FIG. 5 is suspended in a drilled well on a threaded tubular string. The coring BHA includes a coring sampler 52, preferably the sliding sleeve type, for obtaining the downhole sample. The coring sampler 52 includes a drill collar sub 54, with an inner tube 56 axially movable with respect to the drill collar sub, a stabilizer sub 58, and a diamond bit 60. The inner tube stabilizer 62 is provided at the lower end of the stabilizer sub 58, while head sub 64 connects the threaded tubular string to the drill collar sub 54. The threaded tubular string is thus rotated by the drive unit movable along the mast, that provides the torque necessary to rotate the diamond bit 62 and obtain a cored sample. While other types of coring tools have been used for obtaining core samples, the drive unit and the threaded tubular string as provided herein provide a highly reliable technique for obtaining a sizable core sample from hard rock formations.

The present invention is particularly suitable for conducting coring activities for mining operations which require a core sample to return to the surface for analysis. The present invention can also be used for other applications in which a well is drilled and a core sample obtained.

A drill rig as disclosed herein includes an injector which is movable from a position in line with the mast for conducting coil tubing operations, e.g., when drilling the well, but the injector may be spaced laterally from the mast for conducting coring operations which require threaded tubulars. In a preferred embodiment as disclosed herein, the injector will be tilted into and out of alignment with the mast by one or more hydraulic cylinders in a manner similar to the disclosure in WO 2008/068546. In other applications, the injector may be moved laterally relative to the mast from an in line to an out of line position. In the out of line position, the injector is thus sufficiently spaced from the mast so as not to interfere with the movement of threaded tubulars. Moreover, this feature allows the drive unit which moves along the mast and rotates the threaded tubulars to be positioned below the injector, so that when the rig is moving coil tubing with the injector, the coil tubing passes through the drive unit.

The present system presents a huge improvement toward a safer environment for the drill workers as well as a cost effective improvement to the mining exploration drilling practice.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for selectively drilling an earth borehole into a subsurface formation to be cored, comprising:

a rig having a mast;

the mast pivotally supporting an injector thereon said injector being pivotable relative to said mast when said mast is in a fixed position such that said injector has an injector axis offset with respect to a central axis of the mast when the rig is moving threaded tubulars, and in line with the central axis of the mast when the rig is moving coil tubing, the mast supporting the injector both when the injector axis is offset and in line with central axis of the mast, and the mast supporting a drive unit for rotating the threaded tubulars;

a coil tubing drilling assembly for forming an earth borehole into a subsurface formation to be cored, said coil tubing drilling assembly comprising coil tubing, the injector on the mast moving the coil tubing, and a drilling bottomhole assembly including a percussion tool, a shock absorber, and a rotary motor for rotating the percussion tool, each of the percussion tool, shock absorber, and rotary motor being suspended in the well from the coil tubing, the coil tubing passing through the drive unit when drilling the well; and a coring bottomhole assembly operable by said system and including a coring tool, said coring tool comprising a drill collar sub having an inner tube axially movable with respect to said drill collar sub whereby said system can selectively drill a borehole into said formation and obtain a core sample from said formation.

2. A system as defined in claim 1, wherein the drive unit moves along the mast while raising and lowering the threaded string of tubulars, and the drive head is positioned below the injector when the injector is aligned with the mast.

3. A system as defined in claim 1, wherein an incompressible fluid is passed through the coil tubing for activating both a rotary motor and the percussion tool.

4. A system as defined in claim 3, wherein the incompressible fluid is water.

5. A system as defined in claim 1, wherein the rotary motor of the drilling assembly is a steerable rotary motor.

6. A system as defined in claim 1, wherein the mast is pivotal from vertical at a selected angle when moving both coil tubing and threaded tubulars.

7. A system for selectively drilling an earth borehole into a subsurface formation to be cored, comprising:

a rig having a pivotal mast;

the mast pivotally supporting an injector thereon said injector being pivotable relative to said mast when said mast is in a fixed position such that said injector has an injector axis offset with respect to a central axis of the mast when the rig is moving threaded tubulars, and in line with the central axis of the mast when the rig is moving coil tubing, the mast supporting the injector both when the injector axis is offset and in line with the central axis of the mast, and the mast supporting a drive unit below the injector for rotating the threaded tubular and movable along the mast;

a coil tubing drilling assembly for forming an earth borehole into a subsurface formation to be cored, said coil tubing drilling assembly comprising coil tubing, the injector on the mast moving the coil tubing, and a drilling bottomhole assembly including a percussion tool, a shock absorber, and a rotary motor for rotating the percussion tool, each of the percussion tool, shock absorber, and rotary motor being suspended in the well from the coil tubing, the coil tubing passing through the drive unit when drilling the well; and a coring bottomhole assembly operable by said system and including a coring tool, said coring tool comprising a drill collar sub having an inner tube axially movable with respect to said drill collar sub whereby said system can selectively drill a borehole into said formation and obtain a core sample from said formation.

8. A system as defined in claim 7, wherein an incompressible fluid is passed through the coil tubing for activating both a rotary motor and the percussion tool.

9. A system as defined in claim 8, wherein the incompressible fluid is water.

10. A system as defined in claim 7, wherein the rotary motor of the drilling assembly is a steerable rotary motor.

11. A system for selectively drilling an earth borehole into a subsurface formation to be cored, comprising:

a rig having a mast;

the mast pivotally supporting an injector thereon said injector being pivotable relative to said mast when said mast is in a fixed position such that said injector can have an injector axis offset with respect to a central axis of the mast when the rig is moving threaded tubulars, and it can have an injector axis in line with the central axis of the mast when the rig is moving coil tubing, the mast supporting the injector both when the injector axis is offset and in line with central axis of the mast, and the mast supporting a drive unit below the injector for rotating the threaded tubulars;

a coil tubing drilling assembly for forming an earth borehole into a subsurface formation to be cored, said coil tubing drilling assembly comprising coil tubing, the injector on the mast moving the coil tubing, and a drilling bottomhole assembly including a percussion tool, a shock absorber, and a rotary motor for rotating the percussion tool, each of the percussion tool, shock absorber, and rotary motor being suspended in the well from the coil tubing; and a coring bottomhole assembly operable by said system and including a coring tool, said coring tool comprising a drill collar sub having an inner tube axially movable with respect to said drill collar sub;

whereby said system can selectively drill a borehole into said formation and obtain a core sample from said formation.

* * * * *